US005968607A

United States Patent [19]

Lovison

[11] Patent Number: 5,968,607

[45] Date of Patent: Oct. 19, 1999

[54] DEVICE AND METHOD FOR ETCH AND EMBOSS PROCESS PRINTING

[75] Inventor: Douglas I. Lovison, Rancho Santa Fe, Calif.

[73] Assignee: Chromium Graphics, Carlsbad, Calif.

[21] Appl. No.: 08/988,462

[22] Filed: Dec. 10, 1997

[51] Int. Cl.[6] ..... B05D 1/28

[52] U.S. Cl. ..... 427/511; 427/258; 427/261; 427/278; 427/288; 101/177; 101/211; 101/492

[58] Field of Search ..... 427/511, 258, 427/428, 288, 261, 278; 101/211, 154, 487, 490, 492, 177, 183

[56] References Cited

U.S. PATENT DOCUMENTS

| | | | |
|---|---|---|---|
| 1,604,082 | 10/1926 | Smothers . | |
| 1,694,847 | 12/1928 | Donaldson . | |
| 1,867,314 | 7/1932 | Gurwick . | |
| 2,084,026 | 6/1937 | Gurwick . | |
| 2,235,791 | 3/1941 | Wohlers . | |
| 3,751,319 | 8/1973 | Green et al. . | |
| 4,105,806 | 8/1978 | Watt | 427/44 |
| 4,597,210 | 7/1986 | Kitrell . | |
| 4,841,903 | 6/1989 | Bird | 118/46 |
| 4,933,218 | 6/1990 | Longobardi | 428/38 |
| 4,971,646 | 11/1990 | Schell et al. . | |
| 4,978,593 | 12/1990 | Yin et al. . | |
| 5,132,148 | 7/1992 | Reafler . | |
| 5,223,357 | 6/1993 | Lovison . | |

*Primary Examiner*—Shrive Beck
*Assistant Examiner*—Fred J. Parker
*Attorney, Agent, or Firm*—Nydegger & Associates

[57] ABSTRACT

In order to achieve deposit of very complex embossed designs which require thick layers of inks or paints in sharply defined patterns on flexible sheet substrate material suitable for packaging and high-volume production, a new combination of production sheet-fed printing elements is disclosed. As the typical materials will be sheet material supplied on rollers, a continuous process of moving the material from a supply roller to a take-up roller through a series of application and curing steps is provided, including elements for the steps of thick-deposit of design print material, embossing or impressing the deposited material, curing the material and sealing or covering the print material, and taking up the imprinted material for further shaping or processing. Since any number of complex design features, such as multiple colors, differing embossed patterns, and varying thicknesses of design may all be combined in one overall design, the various parts of the design may require sequential application, and the continuous process may therefore embody two or more repetitive stations to apply different aspects of the design. Thus a continuous sequential printing process is provided with separate stations adapted to application of the varying parts of complex designs and the distinct layered construction required for deposit, fixation and stabilization of the imprinted designs.

3 Claims, 3 Drawing Sheets

DEVICE AND METHOD FOR ETCH AND EMBOSS PROCESS PRINTING

FIELD OF THE INVENTION

The field of this invention is printing machinery and processes, and in particular machinery and processes adapted for imprinting of complex raised designs. The present invention is particularly, but not exclusively, useful for placing an extraordinarily thick ridge of ink on a design in a continuous roller-to-roller printing operation.

BACKGROUND OF THE INVENTION

The history of printing by presses and other methods and devices is a long and honored chain of steady invention and improvement. As the demands of information dissemination continue to grow, and as competition for attention in advertising, graphic decoration and education among various media continues to grow, the techniques and technologies of printing move forward to continue the historical progression. The within described invention seeks to extend this line of invention into new areas of graphic attraction heretofore unattained, and usefully introduces printed effects considered too difficult or costly for mass production.

Complex and colorful imprinted graphics, specifically tactile graphics on packaging and display cards with the effects of layering, embossing, engraving and etching are increasingly in demand to distinguish products and displays from less fully-featured printed products. The difficulties in achieving such dramatically new printed effects are considerable, especially when compared to the simplicity and economy of standard flat printing processes. The present invention addresses in particular the forms of packaging in flexible materials such as bags and wrappers, as well as flat forms of printing such as cards and boxes, and the problems inherent in highly decorative tactile deposits of print materials to form complex designs. To illustrate the evolving nature of print methods and devices, declarant himself is a part of the progression, having addressed the problems of depositing of complex etched or embossed effect designs by printing on substrates in the sign industry, which developments have issued in U.S. Pat. Nos. 5,082,703 and 4,933,218, both entitled Sign With Transparent Substrate, issued to Longobardi. In those disclosures, declarant describes and claims signs and methods of producing signs which embody extreme printing achievements. Specifically, the described techniques involve the deposit of extraordinarily thick ridges of viscous ink (or paint material, the use of the word "ink" in this disclosure is intended to include various liquid or semi-liquid materials suitable for producing printed designs of the described types) on generally rigid flat plate substrates. The resultant product is suitable for display signage. Further, these disclosures also present associated techniques of achieving embossed and etched effects, including curing, enhancement and fixation instructions. In the present invention, applicant has extended the long history of printing developments by taking the techniques and processes of the '703 and '218 patents cited above into new territory and materials heretofore thought impossible, ineffective or too costly.

The problems presented by moving from imprinting on a flat, substantially rigid substrate in single or limited production runs to imprinting on a flexible medium in large volume production runs have required overcoming numerous obstacles by development and experimentation. Conventional sheet or continuous roll presses and methods are unable to accommodate the demands of the complex deposits required of the raised and textured effects which are the objects of this invention, and design of wholly new and complex printing equipment and processes is required and achieved in this invention.

While printing technology generally forms the background of the present invention, the '703 and '218 patents to Longobardi cited above disclose the state of the art up to development of the present invention for deposit of printed designs including etched or embossed appearances on a substrate. The designs achieved in that environment which related essentially to transparent substantially flat and rigid substrates such as glass or plastic suitable for signage would be usefully applied to new media in packaging, advertising and art printing if they could be adapted to other substrate material such as sheet mylar and other plastics, paper, cardboard and other flexible sheet and continuous roll types of materials. The designs achieved in the '703 and '218 patents were enabled by the novel combination of layers of ink applied on the surfaces of the substrates, where the designs included a thick ridge of ink at the edges of the designs, which ridge could be further textured to provide complex tactile and visually striking surfaces, and the final deposit over the formed and shaped designs of various topping strata such as adhered thin sheets or spray or powder deposits.

While printing of new attractive designs on sheet material has enjoyed many advances in recent years, as evidenced in such media as magazine covers and advertising inserts, mylar food bag type packaging, and collectible printed media such as trading cards, the new effects described in '703 and '217 patents have not been achieved in imprinting on mass produced flexible substrate media until development of the within described invention. Illustrating one extreme difference in translating from the traditional printing processes to the demands of the new heavily tactile embossed effect designs, ordinary deposit of print material such as colored inks are in the small micron ranges of thicknesses, where the range of thicknesses in at least parts of the new tactile designs must be in the extraordinary range of significant fractions of inches, typically about 0.01 inches or greater in order to provide ridges and patterned surfaces that provide significant visual design information to the observer. Clearly, traditional presses and printing methods are not adaptable to the new requirements of material deposit on flexible substrate material by lack of adjustability and accommodation of the additional deposit, curing and overlay steps necessitated.

Further, while printing methods other than presses, such as jet-printing or drum-and-toner deposit methods can produce significant deposit thicknesses of ink or paint material, significant texturing effects such as embossed or etched effects are unachievable because a press or imprint step is generally missing and an additional cover surface or sealer is also typically required and unavailable in jet-print processes.

In light of the above, it is an object of the within invention to enable richly textured printed designs on flexible sheet material. It is also an objective of the invention to define a process that can produce the textured printed designs in a high volume, high speed production environment. A further objective is to adapt the designs achieved on rigid substrate materials to the more demanding flexible sheet material substrates. Yet another objective of the invention is to define a process that can achieve complex printed designs on either the inside of a packaging enclosure for viewing from the outside or imprinting on the outside alternatively if desired.

SUMMARY OF THE PREFERRED EMBODIMENTS

The present invention accomplishes the above objectives by the development of a combination of newly defined design depository techniques with new combinations of production sheet-fed printing elements. As the typical materials will be sheet material supplied on rollers, a continuous process of moving the material from a supply roller to a take-up roller through a series of application and curing steps is provided. The unique requirements of the thick-deposit of design print material, embossing or impressing the deposited material, curing the material and sealing or covering the print material, require a specific multiple-function, multiple-station setup for which no suitable configuration or process has yet existed in the industry.

Further, since any number of complex design features, such as multiple colors, differing embossed patterns, and varying thicknesses of design may all be combined in one overall design, the various parts of the design may require sequential application, and the continuous process may therefore embody two or more repetitive stations to apply the different aspects of the design. Thus a continuous sequential printing process is provided with separate stations adapted to application of the varying parts of complex designs and the distinct layered construction required for deposit, fixation and stabilization of the imprinted designs.

As contemplated for the present invention, a significant result of the ink application process is the creation of an extraordinarily thick ridge of ink in the printed design. The object in providing this extraordinarily thick ridge of ink is to give an embossed or etched appearance to the printed design. Obtaining an extraordinarily thick ridge of ink, however, is not always easily accomplished. For instance, even though the ink may be quite viscous and will therefore set up without much difficulty, a sufficiently thick deposit of ink may not be realized with only one application. Thus, it can happen that several deposits of ink (two or more) may be needed in order to build-up enough ink on the ridge to achieve the desired visual effect. If so, it is necessary that the print stations be properly positioned relative to each other in order to accurately register subsequent printings on top of previous printings.

For purposes of the present invention a device for printing an extraordinarily thick ridge of ink on a continuous substrate includes a supply spool of the substrate material and a receiving unit. Together, the supply spool and receiving unit operate with a means for drawing the substrate as a sheet from the supply spool to the receiving unit. As intended for the present invention, the drawing means can be any type of motor well known in the art, such as an electric motor. The device also includes a pair of printing stations which are specifically provided to imprint an extraordinarily thick ridge of ink onto the substrate as it moves from the supply spool to the receiving unit in a roller-to-roller operation.

For the printing stations, there is at least a first printing station which is positioned between the supply spool and the receiving unit for laying down a first deposit of ink onto the substrate sheet. As indicated above, this is done as the substrate is drawn from the supply spool to the receiving unit. Additionally, there is a curing unit for curing the first deposit of ink. It may be that this first printing station, alone, will be sufficient to create the extraordinarily thick ridge of ink on the substrate sheet. If so, there is no need for a second printing station. However, if the one printing station is not sufficient for this purpose, the device may also include a second printing station which is positioned between the curing unit of the first printing station and the receiving unit. This second printing station will then lay down a second deposit of ink, in register, over the first deposit of ink on the substrate sheet. With the second printing station there may also be another curing unit for curing the second deposit of ink. The purpose here, of course, is to enhance the extraordinarily thick ridge of ink.

Although the focus of the present invention is on the laying down of an extraordinarily thick ridge of ink, it is to be appreciated that this extraordinarily thick ridge of ink will not necessarily be deposited directly onto the substrate surface. It may well happen, and it is certainly envisioned for the present invention, that a design or pattern will be imprinted on the substrate before the extraordinarily thick ridge of ink is laid down. If this is the case, and normally it will be, print process equipment can be installed between the supply spool and the first printing station for this purpose. Thus, a process printed design will be placed on the substrate before the substrate is presented to the first printing station.

In more detail, both the first and second printing stations of the present invention will include an ink source for holding ink. Preferably this is a relatively viscous ink which is ultraviolet curable. Additionally, each printing station will have three substantially cylindrical rollers. These are: 1) an ink roller which has a smooth surface and is juxtaposed with the ink source for receiving ink therefrom in a substantially uniform layered depth over the smooth surface; 2) a print roller which has a surface that is formed with a raised image in the ridge, the print roller being juxtaposed with the ink roller to receive ink from the ink roller that is on the raised image of the ridge; and 3) a transfer roller which has a textured surface that is juxtaposed with the print roller to receive ink from the raised image of the ridge on the textured surface of the print roller for printing the image of the ridge on the substrate sheet.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
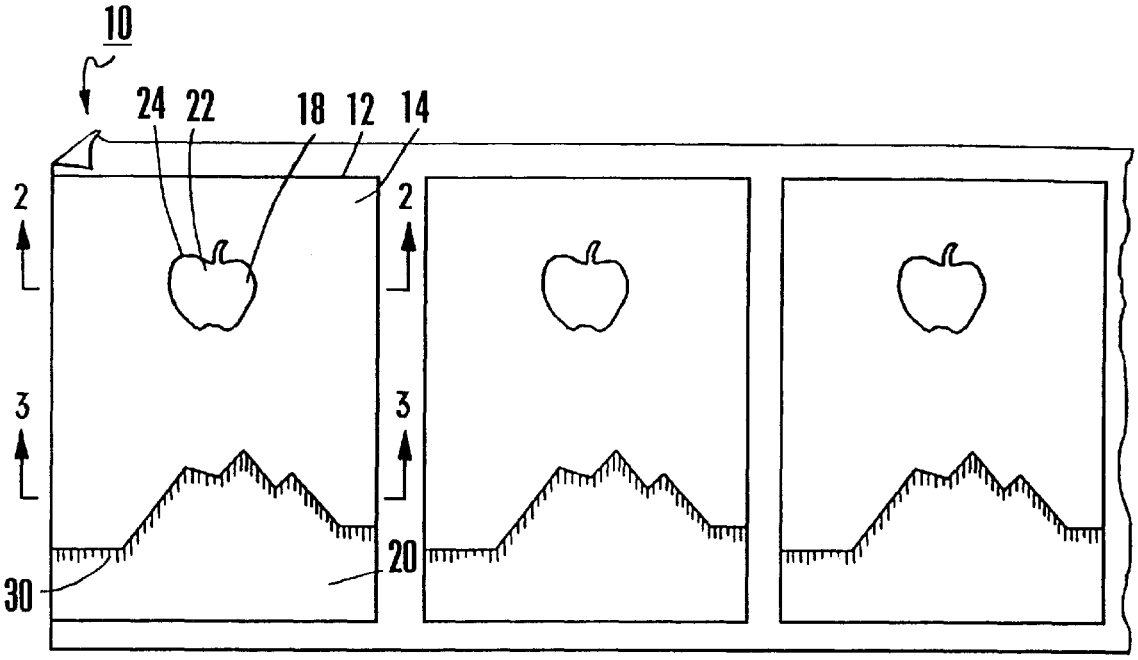
FIG. 1 is a top view of a section of imprinted flexible sheet material as it proceeds through the defined process, showing 3 identical printed designs in sequence.

Referring to the drawings it may be seen in FIG. 1 that a sequence of identical images is imprinted on a moving sheet material substrate 12, fed to the process as shown later by supply and uptake rollers. The top surface 14 serves to receive the printed complex design, although this may be either the outside of the finished product, especially if the product is to present a tactile effect, or it may be the inside of the finished product, in which case the substrate would typically be transparent or translucent and the design would show through the material to the outside observer. The latter effect may usefully present complex textured images through a smooth sealed outside layer, which effect can be graphically dramatic. The apple 18 and mountain 20 of the design is an example of the surface and edges of design objects that may be embodied in a printed design, and even these simple shapes can be easily imagined by the reader of this disclosure to usefully employ depth, textured and color-variegated surfaces, and transition effects from one area of the design to another that can be enhanced with a deposit of thick layers of print material such as inks or paints that will accept significant texturing. For instance, note the thick ridge of ink 24 overlapping edge 26 of ink layer 22. In this example, the ink used for both layer 22 and ridge 24 is relatively viscous. Typically, these inks require curing and are curable within a relatively short period of time. Preferably this curing can be accomplished in seconds such that it can be accommodated in a moving continuous process. More specifically, it is preferred that the ink be curable with ultraviolet light. Further the ink should be relatively viscous, such as any of the enamel, epoxy and acrylic inks in order that a thick layer may be deposited and a complex imprinted or embossed design stamped and retained in the material.

The design edges may be, and typically are, extraordinarily thick compared to the standards and practices of continuous roll-fed printing processes. These ridges in the designs are a key element of placement and fixation of the complex designs contemplated by this invention and are usually greater than approximately one one-hundredth (0.01) of an inch in thickness. Further, increasing the difficulty of the process, it may also be required that the designs vary considerably in thickness to enhance the art of the design. For example, the area of layer 22 may be a flat area of much less thickness down to the small thousandths of an inch.

Figure 2:
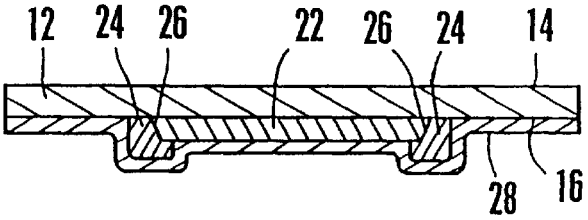
FIG. 2 is a cross-section view of the imprinted sheet material taken along line 2—2 of FIG. 1.
Figure 3:
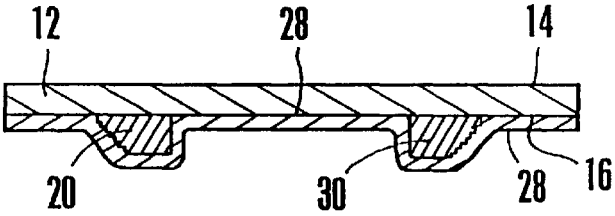
FIG. 3 is a cross-section view of the imprinted sheet material taken along line 3—3 of FIG. 1.

Further as illustrated in FIGS. 2 and 3 in cross section, the deposited design materials on substrate 12 include not only thick ink deposits, such as ridge 24 of the apple edge, they may also include a layer of material deposited over the design (after the inks or paints are suitably subjected to a curing step). The purpose of these additional materials will be to fix and seal the design. Typically this is accomplished by application of a liquid sealing coat 28, or a sealing coat from a wide array of other available methods and materials such as vacuum pressed sheet material or sprays, all of which are subsumed in the term "sealing coat" or "sealer" as used in this disclosure. In the example of FIG. 3 in cross section, it may be seen that the edge area of the mountain portion of the design also includes an impression of texturing on a portion of the ridge. This produces novel visual art effects and is also sealed by a sealing layer 28. Note further that if the raised edges as sealed are presented as the outside surface of the finished product, a tactile surface that displays significant "hand" feeling is open to the viewer. On the other hand, if the substrate is transparent, the same surface could be presented as the inside and the smooth outer side of the substrate presented to the viewer instead. Thus, the choices of effects available to the designer are increased.

Figure 4:
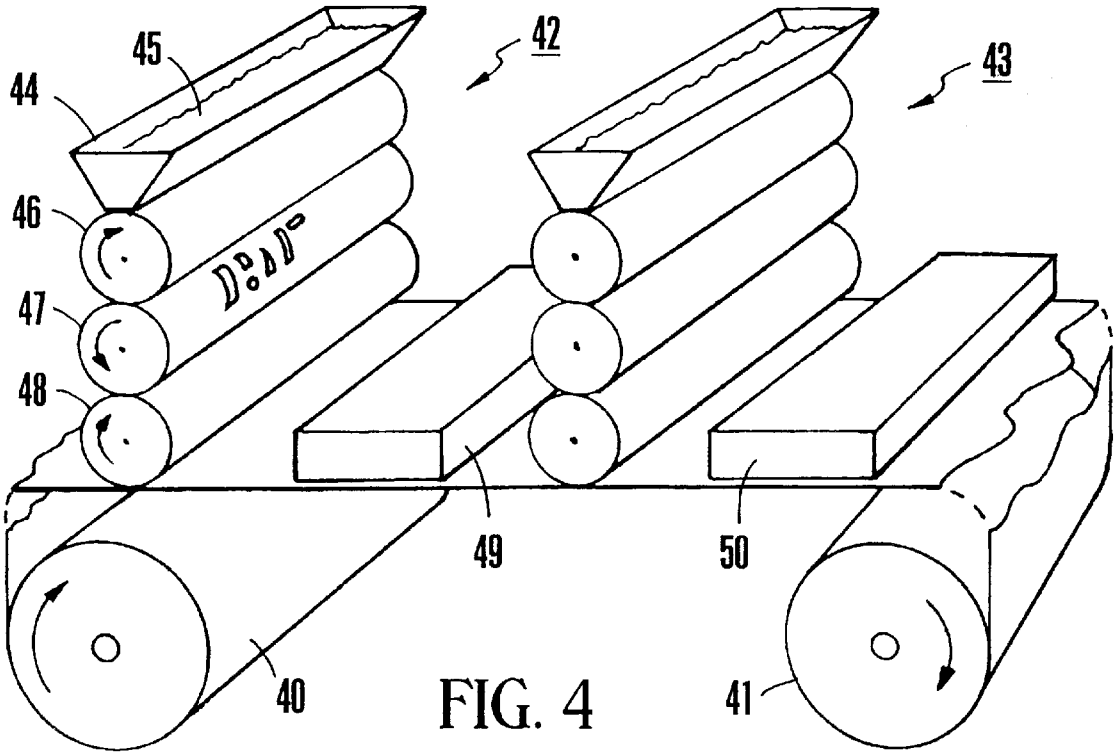
FIG. 4 is a representational side view of the defined printing process showing the materials and production stations.

FIG. 4 illustrates in representational form the elements of the printing process that have been developed for the purposes of the present invention and that are required to achieve its objectives. For the present invention, sheet substrate material is introduced to the process as a supply roll 40 for continuous feed to the process. Typically, the supply roll 40 is propelled by the driving force of a take-up roll 41 (such driving force may be supplemented or replaced by drivers, motors, induction devices or motivators of many optional types as are well known in the mechanical arts). The substrate onto which the printed designs will be placed in a sequential process is passed to one or more imprinting stations. Examples of these imprinting stations are shown here as first imprinting station 42 and second imprinting station 43. It is to be appreciated that, although the number of such stations corresponds generally to the number of design layers, embossing, color variations, other complexities and finishing layers, the number of such stations may be increased as required.

As indicated above, two print stations 42, 43 may be required to achieve a build-up of ink that is sufficient to obtain the visual effects resented by an extraordinarily thick ridge of ink 24, 30. As also indicated above, there may be a need to preprint an image or design on the substrate 12 in addition to the extraordinarily thick ridge of ink 24, 30. If so, such design 18, 20 should be imprinted onto the substrate 12 prior to the creation of the ridge of ink 24, 30. This possibility is not shown in FIG. 4 but is to be considered with reference below to FIG. 6.

Each station 42, 43 typically includes a supply tray 44 for containment and application of inks or paints via a broad application outlet in substantial proximity to first substantially cylindrical ink roller 46. The controlled application of the very viscous ink 45 from the supply tray 44 to the ink roller 46 deposits a layer of ink which is at least as thick as the thickest portion of the design that is carried or presented by design roller plate 47. The design roller plate 47 picks up ink from the ink layer on ink roller 46 by counter-rotating contact between plate 47 and ink roller 46. With this pick up the ink conforms to the design in plate 47 (which is typically an engraved design or color separation screen which will be intuitively understood by those skilled in the printing arts). The design borne by the ink layer on the plate 47 is then transferred to counter-rotating transfer roller 48 for application to the continuously moving substrate sheet passing below. Preferably, the transfer roller 48 is what is commonly known as an analox roller. An analox roller is the preferred method of direct print contact application as the transfer roller because it has a textured surface which reliably holds the ink in the desired design until the ink is transferred to the substrate. It is to be appreciated, however, that other methods and devices known in the art could function equivalently or nearly equivalently and the present invention contemplates employment of these additional or substituted modes of application at one or more of the imprinting stations.

As the thick layer of ink is applied as described, carrying the embossed pattern imposed by the design plate 47 and analox roller 48 will typically require curing for stability and permanence. Accordingly, a curing station 49 is shown as the next process element through which the design carried by the moving substrate will pass. Preferably, the curing station will provide an ultra-violet (UV) source and the ink will be UV curable. Of course, the curing element is also selectable from a wide variety of heat-application and other curing methods and devices as appropriate to the materials used. Reference to "curing station" in this disclosure contemplates selection and employment of any of these alternatives for curing the imprinted materials. While further control of the process speed may be required at the curing stations depending on time requirements for the curing of the materials, these variations can easily be accomplished efficiently by computer-controlled process elements well known in production industries and which are contemplated to be usefully employed in the present invention.

After the first curing of the first imprint, the process may be repeated numerous times at additional print and curing stations, the additional layers or patterns being applied in a closely controlled registration to overlay or abut the previously applied layers or patterns. A final station where a final sealing coat can be applied after all the separate design elements and embossing are accomplished in sequence. The entire sequentially imprinted substrate material then being taken up onto the take-up roll 41 and held for further processing of the printed materials such as slitting, shaping, and assembly as the finished product requires.

Figure 5:
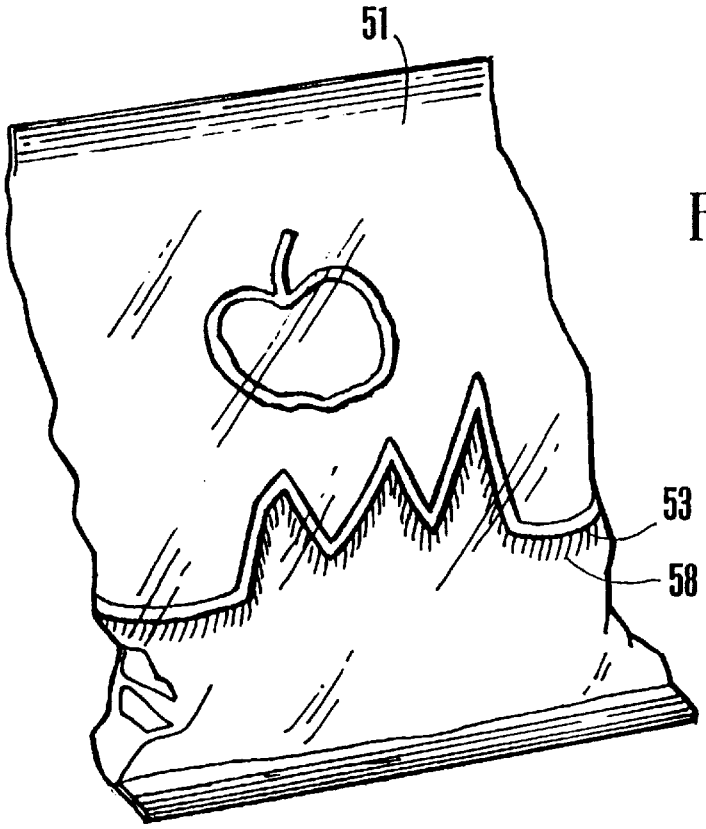
FIG. 5 is a perspective view of a finished typical product in the form of a food product bag.

FIG. 5 illustrates a typical finished product which artistically and attractively displays the imprinted designs. A food product bag 51 is shown here formed from the substrate material. Specifically, bag 51 is made of a transparent plastic packaging material which has been cut and folded into a bag shape, filled with product and the edges sealed. Note that the face of the bag is smooth and the textured designs of apple and mountain are thickly and visibly imprinted on the inside of the bag surface and viewable from the outside. As shown, the design consists in part of a thick ridge print portion 53 at the edge of the mountain design and another more extensive area 58 that carries an embossed pattern of the mountain surface texture which is also visible through the bag material to the outside.

Figure 6:
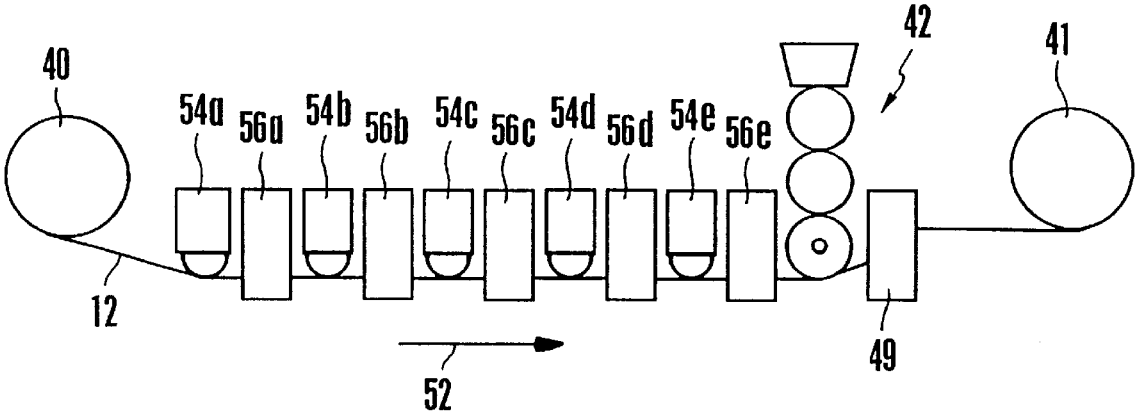
FIG. 6 is a representational side view of a printing process which incorporates printing stations for creating both a process printed image and enhanced highlights for the image.

FIG. 6 shows a typical printing process wherein both color images or designs and extraordinarily thick ridges of ink are applied to the substrate 12. Specifically, as the substrate 12 moves between the supply spool 40 and the receiving unit 41 in the direction indicated by arrow 52, several layers of ink are applied to the surface of the substrate 12. As shown, there may be a plurality of preliminary printing stations 54*a–e* and there may be a respective number of curing stations 56*a–e*. In such an arrangement for the present invention, the preliminary printing stations 54 will apply inks to the substrate 12 for the purpose of creating a design, image or visual presentation on the substrate 12. Once this design, image or visual presentation has been applied to the substrate 12, the extraordinarily thick ridge of ink will be applied. In FIG. 6, only the printing station 42 is shown, however, as will be appreciated by the skilled artisan, if necessary, the printing station 43 (shown in FIG. 4) can be included.

Thus it may be seen that the invention accomplishes all of the objectives set for it and more, enabling and accommodating imprint of very complex designs on flexible substrate material in a high speed production environment.

While the particular Device and Method for Etch and Emboss Process Printing as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A process for imprinting a complex design including an extraordinarily thick ridge of ink on a continuously supplied and uptaken substrate comprising the steps of:

separating the design into a plurality of layers for sequential application to the substrate at a respective plurality of printing stations, wherein at least one of said layers is an extraordinarily thick ridge of ink;

applying each layer at one of said printing stations, and wherein the steps taken for application of the extraordinarily thick ridge of ink include sequentially applying a plurality of overlapping layers of viscous ink to said substrate, wherein application of each said layer of viscous ink includes transferring the ink to a substantially cylindrical ink roller, transferring the ink from the ink roller to a plate bearing the design for the extraordinarily thick ridge of ink, transferring the ink design for the extraordinarily thick ridge of ink from the plate to a transfer roller, and transferring the design for the extraordinarily thick ridge of ink from the transfer roller to the moving substrate beneath the transfer roller; and curing an applied ink layer at a curing station sequentially following one or more of said printing stations.

2. The process of claim 1 further comprising the step of applying a sealing layer over the previously printed design at one of said printing stations.

3. The process of claim 2 further comprising the step of curing said sealing layer at a curing station following the printing station at which the sealing layer is applied.

* * * * *